United States Patent [19]

Tsuzuki et al.

[11] 4,279,619

[45] Jul. 21, 1981

[54] FUEL FOR INTERNAL COMBUSTION ENGINES

[75] Inventors: Kunihiko Tsuzuki; Norio Ogasawara; Shigeo Ema, all of Hamamatsu, Japan

[73] Assignee: Suzuki Jidosha Kogyo Kabushiki Kaisha, Shizuoka, Japan

[21] Appl. No.: 72,759

[22] Filed: Sep. 5, 1979

Related U.S. Application Data

[63] Continuation-in-part of Ser. No. 877,447, Feb. 13, 1978, abandoned.

[30] Foreign Application Priority Data

Jul. 7, 1977 [JP] Japan ..... 52-81216

[51] Int. Cl.[3] ..... C10L 1/02; C10L 1/04

[52] U.S. Cl. ..... 44/56

[58] Field of Search ..... 44/56

[56] References Cited

U.S. PATENT DOCUMENTS

| | | | |
|---|---|---|---|
| 1,516,907 | 11/1924 | Backhaus | 44/56 |
| 2,404,094 | 7/1940 | Robertson | 44/56 |

*Primary Examiner*—Winston A. Douglas
*Assistant Examiner*—Y. Harris-Smith
*Attorney, Agent, or Firm*—Jordan and Hamburg

[57] ABSTRACT

A fuel for internal combustion engines is composed of a mixture of alcohol and gasoline in which the alcohol content is 70 to 85 volume % and the gasoline consists essentially of aromatic, alkanic and cycloalkanic hydrocarbons and, optionally, olefinic hydrocarbons the hydrocarbons having 3–11 carbon atoms, the aromatic hydrocarbons constituting 35 to 45 weight % of the gasoline and the aromatic and any olefinic hydrocarbons constituting cumulatively 35 to 60 weight % of the gasoline.

12 Claims, 3 Drawing Figures

FUEL FOR INTERNAL COMBUSTION ENGINES

REFERENCE TO RELATED APPLICATION

This is a continuation-in-part of application Ser. No. 877,447, filed Feb. 13, 1978, now abandoned.

BACKGROUND OF THE INVENTION

The present invention relates to a fuel for vehicles composed of a mixture of alcohol and gasoline.

The conventional fuel for the internal combustion engine has been mainly gasoline, but various countries are now considering use of alcohol fuel to replace oil, whose reserves are dwindling, and to mitigate air pollution and improve combustion efficiency. The use of alcohol alone, however, has the drawback that the engine is hard to start up because alcohol, such as methyl alcohol or ethyl alcohol, has a low vapor pressure and a high heat of vaporization. The prior art relating to fuel composed of gasoline/alcohol mixtures includes MTZ 37 No. 5, 181 (1976), which discloses a mixture of 15 volume % methanol and 85 volume % gasoline as a fuel and SAE Paper 750123, which discloses fuels composed of mixtures of 5 volume % methanol and 95 volume % gasoline, of 10 volume % methanol and 90 volume % gasoline and of 40 volume % methanol and 60 volume % gasoline; these are, however, low in alcohol content and are not mainly composed of alcohol. These fuels, moreover, are defective in that addition of the slightest volume of water causes separation of the gasoline from the alcohol, leading to trouble with the engine operation.

The primary object of the present invention is to provide a fuel for internal combustion engines which is a mixture mainly composed of alcohol, being intended as a countermeasure anticipating the future shortage of oil supplies.

Another object of the present invention is to provide a fuel composed of a mixture of alcohol and gasoline for internal combustion engines which is characterized by good engine startability as well as no separation into two layers through addition of a little water.

Still another object of the present invention is to provide a fuel for internal combustion engines which, because its combustion produces lower emissions of $NO_x$, CO and HC (hydrocarbons) and less generation of soot than gasoline, is advantageous from the anti-emission and anti-fume standpoints.

Still another object of the present invention is to provide a fuel which is less liable to decompose and deteriorate rubber parts.

Still another object of the present invention is to provide a low-temperature burning fuel which is less liable to deteriorate the lubricant and, accordingly, is capable of reducing seizure due to a broken film of lubricant.

Still another object of the present invention is to provide a fuel which can more easily burn completely than gasoline, accordingly hardly generates carbon and is less liable to cause sticking of a piston-ring.

Still another object of the present invention is to provide a fuel which has a higher octane number and a higher burning efficiency than gasoline.

Other objects and advantages of the present invention will be apparent from the following detailed description of preferred embodiments of the invention.

SUMMARY OF THE INVENTION

According to the present invention, there is provided a fuel for internal combustion engines consisting essentially of a mixture of alcohol and gasoline in which the alcohol content is 70 to 85 volume %, preferably 75 to 85 volume %, and the gasoline consists essentially of aromatic, alkanic and cycloalkanic hydrocarbons and, optionally, olefinic hydrocarbons, the hydrocarbons having 3–11 carbon atoms, the aromatic hydrocarbons constituting 35 to 45 weight % of the gasoline and the aromatic and any olefinic hydrocarbons constituting cumulatively 35 to 60 weight % of the gasoline. The gasoline used in the present invention has a high content of aromatic hydrocarbons. Therefore, in comparison to a fuel for internal combustion engines consisting only of low boiling point hydrocarbons, in the present invention there is no risk of vapor locking even if the proportion of gasoline in the mixture of alcohol and gasoline is 15–30 volume %. The boiling point range of gasoline used in the present invention is typically 25° to 210° C., and the specific gravity of the gasoline is typically 0.72 to 0.77.

Instead of gasoline, the fuel according to the invention is supplied to and burned in the combustion chambers of internal combustion engines; all internal combustion engines have, of course, at least one combustion chamber.

Methyl alcohol, ethyl alcohol and mixtures of methyl alcohol and ethyl alcohol are preferred as the alcohol in the present invention. If an alcohol with a larger number of carbon atoms is employed, atomization of the fuel for starting the engine becomes difficult on account of the higher boiling point, i.e., engine-startability is poor, and the effect of the present invention will not be fully realized. Consequently, the general term "alcohol" as used hereinbelow refers to ethyl alcohol or methyl alcohol or mixtures of ethyl alcohol and methyl alcohol.

In the fuel according to the present invention the alcohol content in the mixture should be 70 to 85 volume %. At less than 70 volume % of alcohol, the slightest addition of water will cause separation of alcohol and gasoline into two layers, and at more than 85 volume % of alcohol, the engine-startability seriously deteriorates; thus, in both cases the effect of the present invention cannot be realized. Especially when methyl alcohol is employed, the alcohol content is desirably set at 75 to 85% for the purpose of preventing alcohol separation due to infiltration of water and improving the engine-startability.

It has been confirmed in a test of actual vehicles that the engine-startability, which depends on the value of the 10% distill point of the fuel, can be considerably improved when more than 15 volume % of gasoline is added and, thereby, the 10% distill point drops.

DESCRIPTION OF PREFERRED EMBODIMENTS

The present invention will be further described by reference to specific embodiments thereof, with reference to the drawings and the following examples.

The results obtained by analyzing gasoline used in the following examples by means of a gas chromatograph are shown in Table 1 below. The gas chromatograph analyzing meter which is used is Model GC-6A manufactured by Shimazu Seisakusho (Inspector: FID). Gasoline of test sample A in Table 1 was used for Examples 1 and 3, and gasoline of test sample B in the Table 1 was used for Examples 2 and 4.

TABLE 1

| Ingredients | Test sample A (weight %) | Test sample B (weight %) |
|---|---|---|
| alkanic hydrocarbons | 37.8 | 38.36 |
| cycloalkanic hydrocarbons | 15.5 | 13.77 |
| olefinic hydrocarbons | 4.9 | 1.1 |
| aromatic hydrocarbons | 35.7 | 41.57 |
| unknown ingredient(s) | 6.1 | 5.2 |

EXAMPLE 1

Using the fuel mixtures according to the present invention and control fuels, the number of kicks needed to start a motorbicycle was counted, the results being summarized in the following table. Using the same fuels, the volume of water added which causes separation of alcohol and gasoline was measured. Only in the case of the control fuel H, addition of 2 volume % of water caused separation into two layers; in all the other cases the fuel remained unseparated.

TABLE 2

| Mixed fuel | | Alcohol Ethyl (volume %) | Alcohol Methyl (volume %) | Gasoline (volume %) | No. of kicks to start |
|---|---|---|---|---|---|
| Mixed fuels of invention | A | 70 | | 30 | 1 |
| | B | 75 | | 25 | 1 |
| | C | 80 | | 20 | 1 |
| | D | 85 | | 15 | 3 |
| | E | | 70 | 30 | 1 |
| | F | | 80 | 20 | 1 |
| | G | | 85 | 15 | 1 |
| Control fuels | H | | 65 | 35 | 1 |
| | I | 90 | | 10 | 10 |
| | J | | 95 | 5 | 13 |
| | K | | 100 | 0 | 20 |

As seen from the above Table 2, the fuel mixtures according to the present invention give notably better engine-startability than the control fuels of high alcohol contents and, compared with the control fuel of low alcohol content, they are less liable to be separated into two layers by addition of a little water. Thus the fuel mixtures according to the present invention are extremely suitable as motor vehicle internal combustion engine fuels.

EXAMPLE 2

Figure 1:
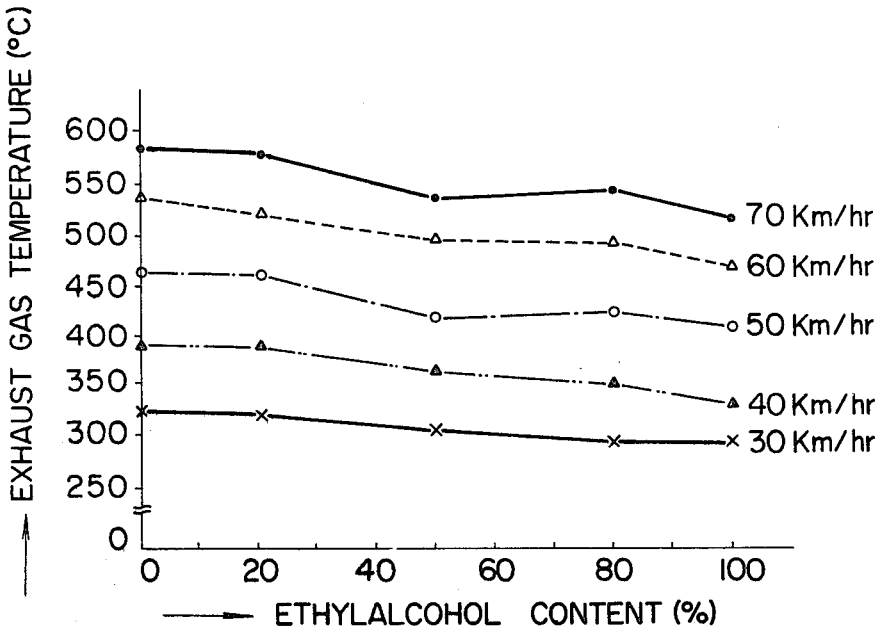
FIG. 1 is a graph illustrating exhaust temperature versus volumetric ethyl alcohol content for a fuel mixture within the scope of the invention, control fuel mixtures of ethyl alcohol and gasoline, 100% ethyl alcohol and 100% gasoline at various engine speeds.

Using the fuel mixtures according to the present invention and control fuels, motorbicycles were run at 30, 40, 50, 60 and 70 km/hr and the exhaust gas temperature was measured at 100 mm behind the exhaust port, the results being summarized in FIG. 1.

From FIG. 1 it is evident that when the fuel mixtures according to the present invention are used, the exhaust gas temperature is lower than when gasoline is used as the fuel. Thus, the durability of the muffler is higher than when gasoline is used as the fuel and, with the combustion temperature lower, the lubricant suffers less deterioration.

EXAMPLE 3

Figure 2:
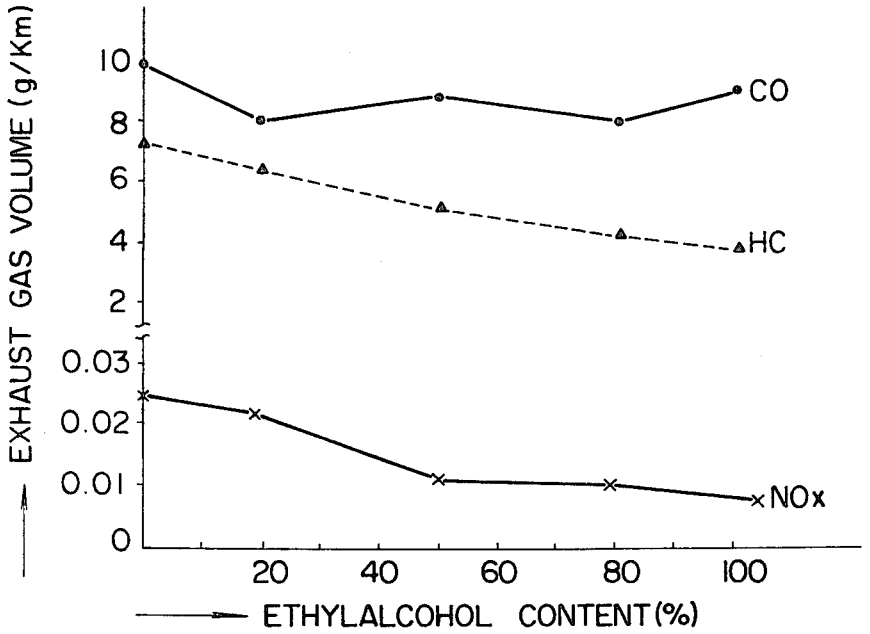
FIG. 2 is a graph illustrating the proportions by weight of CO, HC and $NO_x$ in the exhaust gas for a fuel mixture within the scope of the invention, control fuel mixtures of ethyl alcohol and gasoline, 100% ethyl alcohol and 100% gasoline.

Using the mixed fuels according to the present invention and control fuels, motorbicycles were hot-started and the proportions by weight of $NO_x$, CO and HC in the exhaust gas were measured by "EPA Urban Dynamometer Driving Schedule for motorcycle", the results being summarized in FIG. 2.

As evident from FIG. 2, the proportions by weight of $NO_x$, CO and HC in the exhaust gas are less with the use of fuel mixtures according to the present invention than with the use of gasoline as the fuel.

EXAMPLE 4

Figure 3:
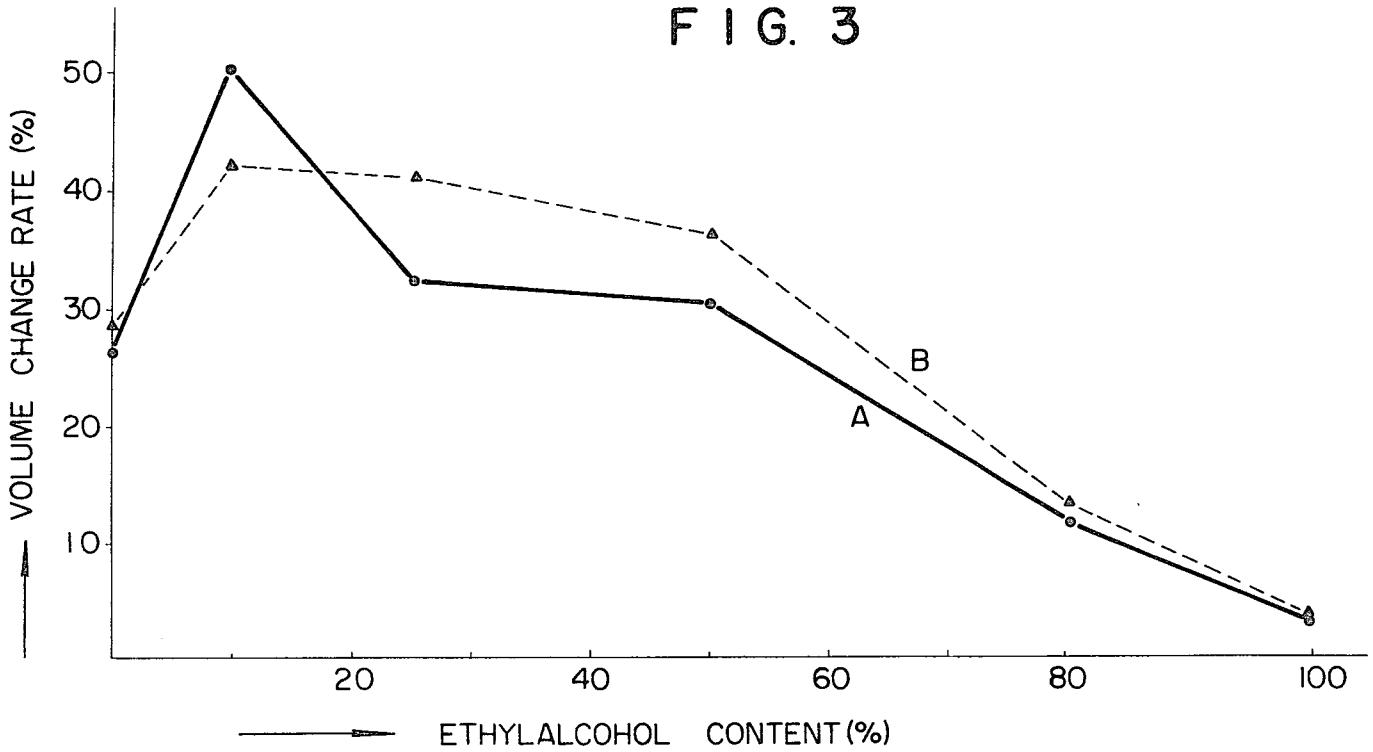
FIG. 3 is a graph illustrating the swelling, expressed as a percentage increase in volume, of an oil seal and an O-ring immersed in a fuel mixture within the scope of the invention, control fuel mixtures of ethyl alcohol and gasoline, 100% ethyl alcohol and 100% gasoline.

Rubber parts, namely an oil seal and an O-ring, employed at junctures in a vehicle, were immersed in the fuel mixtures according to the present invention and in control fuels and 24 hours later the volume changes in these parts were measured, the results being summarized in FIG. 3, in which A represents the oil seal and B represents the O-ring. As seen from FIG. 3, the fuel mixtures according to the present invention are less liable to dissolve or deteriorate the rubber parts than gasoline or fuel mixtures of lower alcohol content.

As seen from the above examples, the fuel mixtures according to the present invention have many advantages. As compared with alcohol, they give better engine startability; they do not separate into gasoline and alcohol; since the octane number of ethyl alcohol is over 100 and that of methyl alcohol is over 110, the octane number of the fuel mixtures of the invention is higher than that of gasoline and, accordingly, they can raise the compression ratio of the engine; since alcohol burns faster and at a lower temperature, the exhaust gas temperature is lower and the exhaust gas contains lower proportions of $NO_x$, CO, HC; since alcohol contains less carbon, soot is less likely to be generated; and for these latter reasons, these fuels are advantageous from the anti-pollution point of view.

Besides, the fuel mixtures according to the present invention are less liable to dissolve or deteriorate the rubber parts than gasoline. Since alcohol burns at a lower temperature than gasoline, the lubricant, for example, oil, suffers less deterioration with less seizure caused by a breaking of lubricant film. Since alcohol easily burns completely with little generation of carbon, sticking of the piston rings is less likely to happen than when gasoline is used.

Moreover, the mixed fuel according to the present invention is promising as a "post-gasoline" fuel, because it enables substitution of gasoline with cheap alcohol as oil resources become depleted and the price of gasoline soars.

What is claimed is:

1. Fuel for an internal combustion engine consisting essentially of a mixture of gasoline and an alcohol selected from the group consisting of ethyl alcohol, methyl alcohol and mixtures of ethyl alcohol and methyl alcohol, the alcohol constituting 75 to 85 volume % of the mixture and the gasoline consisting essentially of 3 to 11 carbon atom alkanic, aromatic, and cycloalkanic hydrocarbons, the aromatic hydrocarbons constituting 35 to 45 weight % of the gasoline.

2. Fuel according to claim 1, in which the alcohol is ethyl alcohol.

3. Fuel according to claim 1, in which the alcohol is a mixture of ethyl alcohol and methyl alcohol.

4. Fuel according to claim 1, in which the specific gravity of the gasoline is 0.72–0.77.

5. Fuel according to claim 1, in which the range of boiling points of the gasoline is 25°–210° C.

6. Fuel according to claim 1, in which the alcohol is methyl alcohol.

7. Fuel for an internal combustion engine consisting essentially of a mixture of gasoline and an alcohol selected from the group consisting of ethyl alcohol, methyl alcohol and mixtures of ethyl alcohol and methyl alcohol, the alcohol constituting 75 to 85 volume % of the mixture and the gasoline consisting essentially of 3 to 11 carbon atom aromatic, alkanic, cycloalkanic and olefinic hydrocarbons, the aromatic hydrocarbons constituting 35 to 45 weight % of the gasoline and the aromatic and olefinic hydrocarbons constituting cumulatively from above 35 to 60 weight % of the gasoline.

8. Fuel for an internal combustion engine according to claim 7, in which the alcohol is ethyl alcohol.

9. Fuel for an internal combustion engine according to claim 7, in which the alcohol is a mixture of ethyl alcohol and methyl alcohol.

10. Fuel for an internal combustion engine according to claim 7, in which the specific gravity of the gasoline is 0.72–0.77.

11. Fuel for an internal combustion engine according to claim 7, in which the range of boiling points of the gasoline is 25°–210° C.

12. Fuel for an internal combustion engine according to claim 7, in which the alcohol is methyl alcohol.

* * * * *